United States Patent [19]

Lorenzo

[11] Patent Number: 4,753,278

[45] Date of Patent: Jun. 28, 1988

[54] CUTTER BLOCK FOR ROTARY VENEER CUTTING MACHINES FOR CONVERTING A BLOCK OF WOOD INTO VENEERS

[76] Inventor: Cremona Lorenzo, Via Ramazzotti, 9 - 20052 Monza (Milano), Italy

[21] Appl. No.: 44,730

[22] Filed: May 1, 1987

[30] Foreign Application Priority Data

May 22, 1986 [IT] Italy ..... 20539 A/86

[51] Int. Cl.[4] ..... B27L 5/02

[52] U.S. Cl. ..... 144/213; 144/212; 144/365

[58] Field of Search ..... 144/209 R, 211, 212, 144/213, 365

[56] References Cited

U.S. PATENT DOCUMENTS 3,473,584 10/1969 Reed ..... 144/212
3,584,666 6/1971 Jensen ..... 144/213
3,654,973 4/1972 Koss ..... 144/213
4,392,519 7/1983 Calvert ..... 144/212

*Primary Examiner*—W. Donald Bray
*Attorney, Agent, or Firm*—Finnegan, Henderson, Farabow, Garrett & Dunner

[57] ABSTRACT

A cutter block for rotary veneer cutting machine for converting a block of wood into veneers is positionwise registrable with respect to the frame of the machine which supports it, so as to permit regulation of the cutting angle of the cutter, the cutting edge of which is parallel to the axis of rotation of the block of wood.

To this end, the cutter block is mounted on the machine frame along a registration fulcrum pin which is not coincident with the cutting edge of the cutter and to which is imparted a combined movement of rotation and translation.

Control means for obtaining such movement are associated with the registration fulcrum pin.

4 Claims, 4 Drawing Sheets

CUTTER BLOCK FOR ROTARY VENEER CUTTING MACHINES FOR CONVERTING A BLOCK OF WOOD INTO VENEERS

The present invention relates to a cutter block for rotary veneer cutting machines for converting a block of wood into veneers.

As is known, in rotary veneer cutting machines the cutter angle is required to be varied in relation to the diameter of the block of wood being cut and to its hardness.

For this purpose, in veneering machines of known type the cutter block is mounted on the frame of the machine through the intermediary of terminal bearings and its angular position can be registered by means of rotation about a fulchrum pin which is coincident with the cutting edge.

Connected to the cutter block are also actuators of various kinds which the operator employs to vary the angular position of the cutter block, and thus the cutting angle.

The construction of a veneer cutting machine of the type described above, i.e. with a cutter block rotatable about a fulchrum pin that is coincident with the cutting edge of the cutter, suffers from the disadvantage that the mounting of the cutter block is closely associated with that of the frame and the other component parts of the machine, is not a flexible operation and is thus costly and time-consuming.

The general object of the present invention is to obviate the aforesaid disadvantage of the known art by embodying a cutter block of a structure such that is can be constructed as a modular unit wholly independent of the rest of the veneer cutting machine.

According to the invention the said object is achieved by embodying a cutter block for a rotary veneer cutting machine of the type in which the cutting angle of the cutter, the cutting edge of which is parallel to the axis of rotation of the block of wood, can be registered by rotating the translating cutter block with respect to the machine frame supporting it, wherein the said cutter block is mounted in a removable manner on the said frame along a registration fulchrum pin which is not coincident with the cutting edge and to which is imparted a combined movement of rotation and translation, control means for obtaining the said combined movement being associated with the said registration fulchrum pin.

In a preferred form of embodiment of the invention, the entire cutter block is mounted on a trolley translatable on lateral guides of the machine frame, the rear wheels of said trolley being rotatable about their own rotation axis and about the aforesaid registration pin which is eccentric with respect to the rotation axis.

The structural and functional characteristics of the invention, and its advantages over the known art, will become more apparent from an examination of the following description referred to the appended diagrammatic drawings, which show one form of practical embodiment of a cutter block realized in accordance with the principles of the invention.

Figure 1:
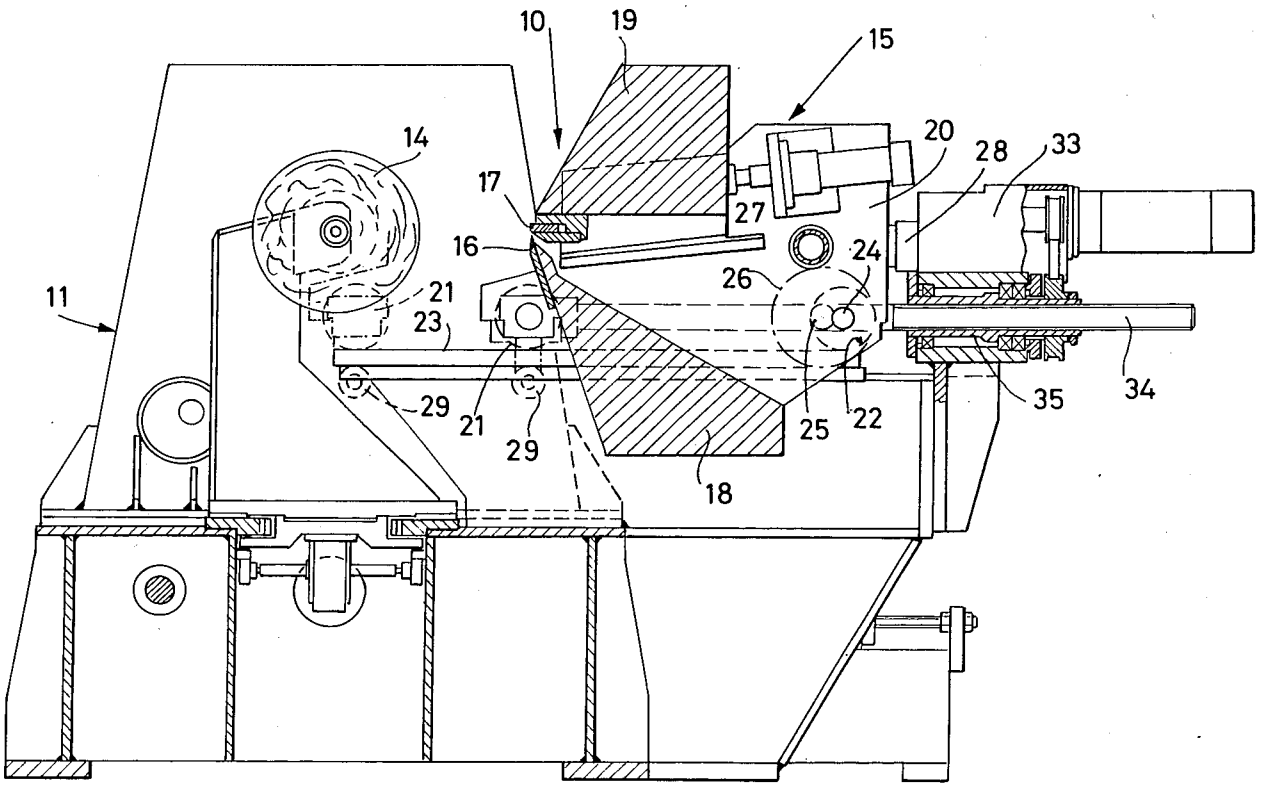
FIGS. 1 and 2 are two sectional views taken respectively through the planes I—I and II—II of FIG. 3.
Figure 2:
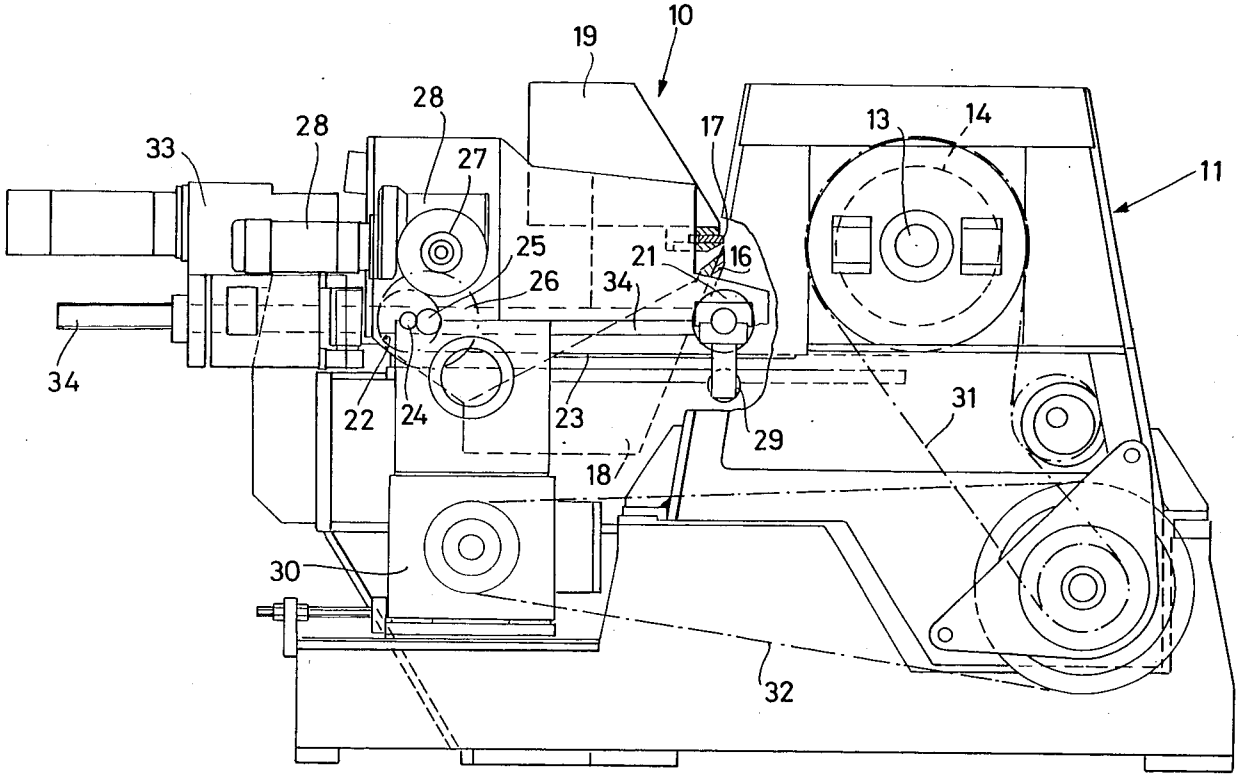
Figure 3:
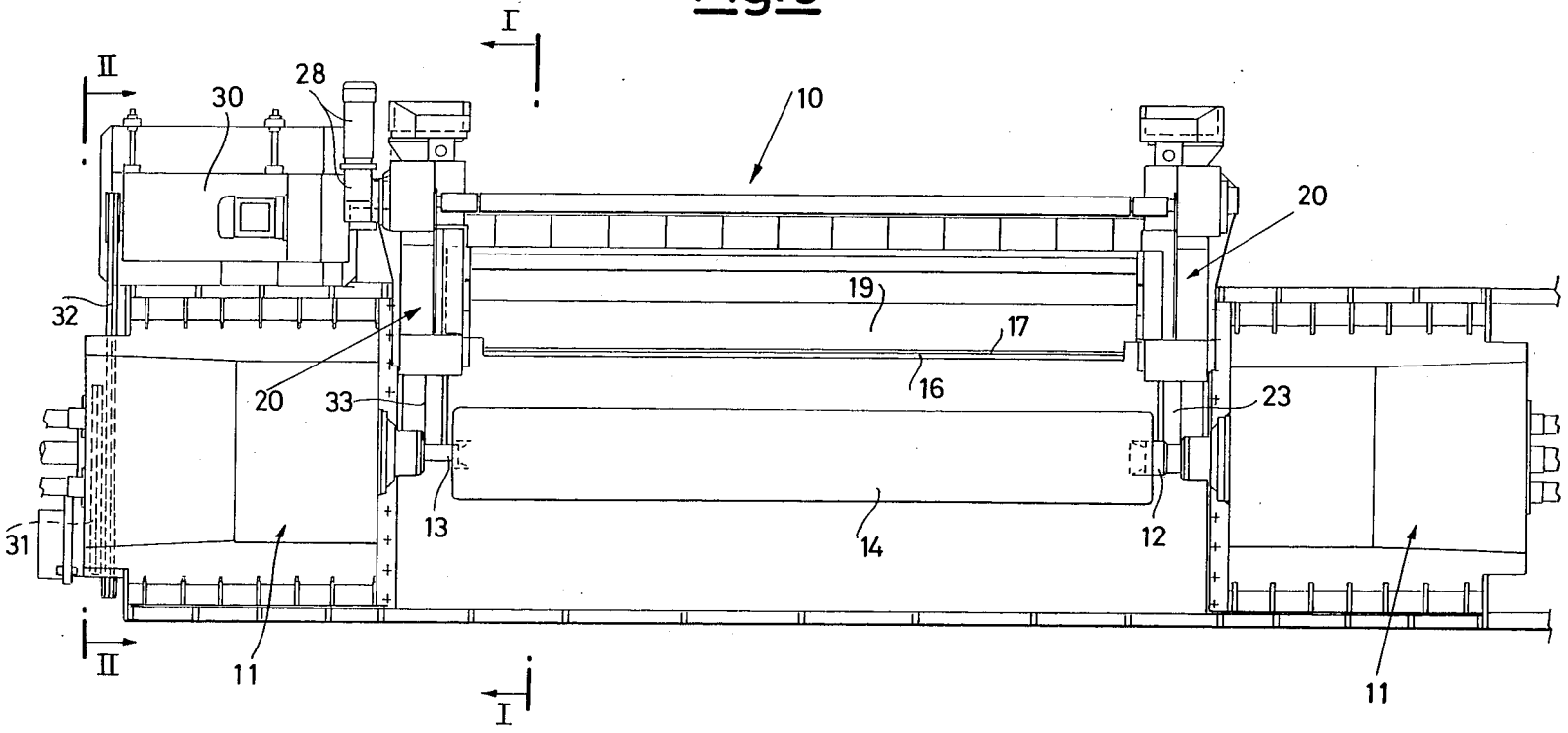
FIG. 3 is a plan view showing a veneer cutting machine comprising the cutter block of the invention.

In FIGS. 1–3, the numeral 10 indicates overall a veneer cutting machine for converting a block of wood into veneers, which comprises in a conventional manner a frame 11 carrying a pair of rotating coaxial mandrels 12, 13 for supporting a block of wood 14 to be cut.

A cutter block embodied according to the principles of the present invention is indicated overall by 15.

The cutter block 15 comprises a cutter 16 and a pressure bar 17 carried by respective beams 18, 19 mounted on a trolley 20 provided with a pair of front wheels 21 and a pair of rear wheels 22.

The trolley 20 can translate on guides 23 of the machine frame 11.

As well as being freely rotatable about their own axis 24, the rear wheels 22 are restrained to an eccentric registration pin 25 of a toothed wheel 26 engaging a pinion 27 keyed to the output shaft of a drive motor 28.

Freely rotating check rollers 29, with a certain minimal clearance in respect of the guides 23, cooperate with the front wheels 21 to guide the trolley 20 as it moves toward the block of wood to be cut.

In a manner per se known, a motor 30, through the intermediary of chain transmissions 31 and 32, rotates the mandrels supporting the block of wood, the entire cutter block being fed in the usual manner by another motor 33 by means of a kinematic chain comprising a nut screw 34 and leading screw 35 mechanism restrained to the front wheels 21 of the trolley 20.

These drives are not here described in greater detail in that they are of a kind well known to persons with ordinary skill in the art.

The foregoing description referred to the appended drawings makes it clear that, through the intermediary of a trolley 20 and the eccentric registration fulchrum pin 25, the cutter block 15 is mounted on the guides 23 in a position-wise registrable manner, with a combined movement of rotation and translation of the fulchrum pin 25 which causes a variation of the cutting angle of the cutter 16. That is, rotation of the registration pin 25 about the axis 24 of the rear wheels 22 generates a rotation of the cutter block 15 about the axis of the front wheels 21 and thus generates a rotation-translation of the cutter 16.

Figure 4:
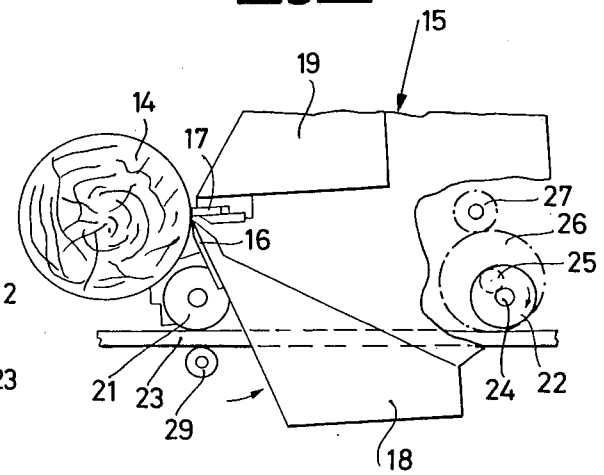
FIGS. 4–6 are diagrammatic views showing, in succession, the operating stages of the cutter block of the invention as the diameter of the block of wood becomes smaller.
Figure 5:
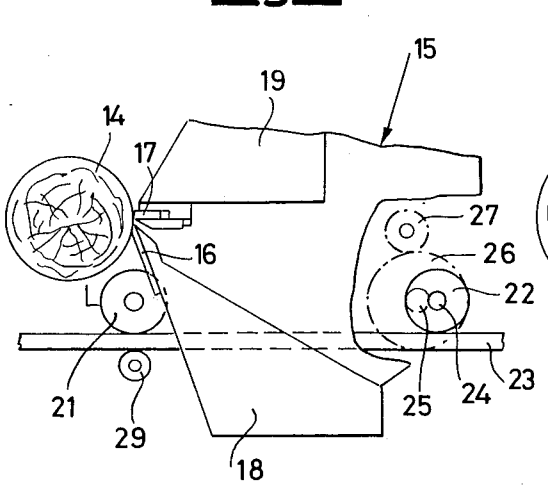
Figure 6:
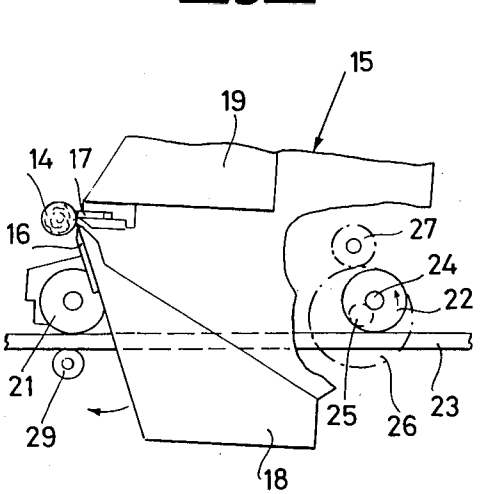

This system of regulation is illustrated in the diagrammatic drawings of FIGS. 4, 5 and 6 which show how, as the diameter of the blcok of wood progessively diminishes, the cutting angle can be registered simply by bringing the motor 28 into operation through the intermediary of the kinematic chain consisting of the pinion 27, the toothed wheel 26 and the eccentric fulchrum pin 25, which last is restrained to the rear wheels 22 of the trolley 20.

As the pin 25 performs a combined movement of rotation and translation, when the cutting angle of the cutter 16 is regulated a small error will occur in the position of the cutter 16 with respect to the block of wood.

This error is corrected by augmenting the feed of the trolley by means of the motor 33.

Both the motors 30 and 33 can be brought into operation in a programmed and automatically controlled manner by a computer, on the basis of the characteristics of the material being cut.

If the cutting angle is not regulated during the cutting operation, it follows that there will be no error in the position of the cutter with respect to the block of wood.

The foregoing description referred to the appended drawings also makes it clear that the cutter block 15 carried by the trolley 20 is embodied in the form of an independent unit which can be mounted on and demounted from the rest of the machine as a single whole by simply disconnecting the power connections, with all the resulting self-evident advantages.

I claim:

1. A rotary veneer cutting machine for converting a block of wood into veneers, which machine comprises:

(a) a frame;

(b) rotary means supported by said frame for supporting and rotating a block of wood to be cut;

(c) a cutter block, including a cutter, supported by said frame, saud cutter having a cutting edge parallel to the axis of rotation of said block of wood for cutting veneers therefrom and said cutter block being rotatable with respect to said frame;

(d) cutter block rotating means for rotating said cutter block about a rotational axis which does not coincide with said cutting edge, so as to regulate the cutting angle of said cutter with respect to said block of wood, said cutter block rotating means being supported by said frame.

2. The rotary veneer cutting machine of claim 1, further including:

(a) lateral guides on said frame;

(b) a trolley;

(c) a pair of front and rear wheels supporting said trolley in said guides and each of said wheels having a rotational axis, said front wheels being positioned on said trolley toward said block of wood and said rear wheels being positioned on said trolley away from said block of wood;

(d) said trolley being laterally translatable on said frame so that said cutting edge may be fed into said block of wood; and (e) wherein said cutter block is rotatably mounted on said trolley, and said cutter block rotating means rotates said cutter block about the rotational axis of said front wheels.

3. The veneer cutting machine of claim 2, wherein said cutter block rotating mean as includes an eccentric registration pin, and said rear wheels are freely rotatable about their rotational axis and are restrained to said registration pin.

4. The veneer cutting machine of claim 3, further including a drive motor, a pinion keyed to said drive motor. A toothed wheel engaging said pinion and wherein said eccentric registration pin is on said toothed wheel.

* * * * *